US006036791A

United States Patent [19]

Mitsuhashi et al.

[11] Patent Number: 6,036,791

[45] Date of Patent: Mar. 14, 2000

[54] COLUMNAR CRYSTALLINE NI-BASED HEAT-RESISTANT ALLOY HAVING HIGH RESISTANCE TO INTERGRANULAR CORROSION AT HIGH TEMPERATURE, METHOD OF PRODUCING THE ALLOY, LARGE-SIZE ARTICLE, AND METHOD OF PRODUCING LARGE-SIZE ARTICLE FROM THE ALLOY

[75] Inventors: Akira Mitsuhashi; Michi Misumi; Saburou Wakita, all of Omiya, Japan

[73] Assignees: Mitsubishi Materials Corporation; Mitsubishi Heavy Industries, Ltd., both of Tokyo, Japan

[21] Appl. No.: 09/012,553

[22] Filed: Jan. 23, 1998

[30] Foreign Application Priority Data

| | | | |
|---|---|---|---|
| Jan. 23, 1997 | [JP] | Japan | 9-010346 |
| Jan. 23, 1997 | [JP] | Japan | 9-010347 |
| Mar. 31, 1997 | [JP] | Japan | 9-096526 |

[51] Int. Cl.[7] ..... C22C 19/05; C22F 1/10

[52] U.S. Cl. ..... 148/404; 148/555; 148/556; 148/410; 148/428

[58] Field of Search ..... 148/404, 555, 148/556, 410, 428

[56] References Cited

U.S. PATENT DOCUMENTS

| | | | |
|---|---|---|---|
| 5,100,484 | 3/1992 | Wukusick et al. | 148/404 |
| 5,154,884 | 10/1992 | Wukusick et al. | 148/404 |
| 5,516,381 | 5/1996 | Kawai et al. | 148/410 |

*Primary Examiner*—Deborah Yee

*Attorney, Agent, or Firm*—Oblon, Spivak, McClelland, Maier & Neustadt, P.C.

[57] ABSTRACT

An Ni-base heat resistant alloy, has a composition which contains, by weight, Cr: from 12.0 to 14.3%, Co: from 8.5 to 11.0%, Mo: from 1.0 to 3.5%, W: from 3.5 to 6.2%, Ta: from 3.0 to 5.5%, Al: from 3.5 to 4.5%, Ti: from 2.0 to 3.2%, C: from 0.04 to 0.12%, B: from 0.005 to 0.05%, and the balance substantially Ni and inevitable impurities. A large-size casting, as well as a large-size turbine blade, having a columnar crystalline Ni-base heat-resistant alloy formed from the Ni-base heat-resistant alloy, have sound cast surfaces and a sound internal structure.

25 Claims, No Drawings

COLUMNAR CRYSTALLINE NI-BASED HEAT-RESISTANT ALLOY HAVING HIGH RESISTANCE TO INTERGRANULAR CORROSION AT HIGH TEMPERATURE, METHOD OF PRODUCING THE ALLOY, LARGE-SIZE ARTICLE, AND METHOD OF PRODUCING LARGE-SIZE ARTICLE FROM THE ALLOY

BACKGROUND OF THE INVENTION

1. Field of the Invention

The present invention relates to a columnar Ni-base heat-resistant alloy which exhibits high resistance to intergranular corrosion at high temperature, capable of providing cast articles having sound surfaces and internal structure. More particularly, the present invention is concerned with a large-size cast article, in particular a large-size turbine blade, having sound surfaces and internal structure and exhibiting superior intergranular corrosion at high temperature, made by casting from the Ni-base heat-resistant alloy.

2. Description of the Background

It is well known that blades of dynamic machines, such as rotor and stator blades of gas turbines, rotor blades of hot-gas blowers and so forth, are made by casting from Ni-base heat-resistant alloys. For instance, Japanese Patent Laid-Open No. 6-57359 discloses the following Ni-base heat-resistant alloys (a) to (d), as materials suitable for rotor and stator blades of gas turbines and rotor blades of hot-gas blowers:

(a) An Ni-base heat-resistant alloy possessing superior strength, oxidation resistance and corrosion resistance at high temperature, having a composition containing, by weight: Cr: from 13.1 to 15.0%, Co: from 8.5 to 10.5%, Mo: from 1.0 to 3.5%, W: from 3.5 to 4.5% Ta: from 3.0 to 5.5%, Al: from 3.5 to 4.5%, Ti: from 2.2 to 3.2%, C: from 0.06 to 0.12%, B: from 0.005 to 0.025%, Zr: from 0.010 to 0.050%, Mg and/or Ca from 1 to 100 ppm, and the balance substantially Ni and incidental impurities;

(b) an Ni-base heat-resistant alloy possessing superior strength, oxidation resistance and corrosion resistance at high temperature, having a composition containing, by weight: Cr: from 13.1 to 15.0%, Co: from 8.5 to 10.5%, Mo: from 1.0 to 3.5%, W: from 3.5 to 4.5%, Ta: from 3.0 to 5.5%, Al: from 3.5 to 4.5%, Ti: from 2.2 to 3.2%, C: from 0.06 to 0.12%, B: from 0.005 to 0.025%, Zr: from 0.010 to 0.050%, Hf: from 0.2 to 1.5%, Mg and/or Ca from 1 to 100 ppm, and the balance substantially Ni and incidental impurities; and (c) an Ni-base heat-resistant alloy possessing superior strength, oxidation resistance and corrosion resistance at high temperature, having a composition containing, by weight: Cr: from 13.1 to 15.0%, Co: from 8.5 to 10.5%, Mo: from 1.0 to 3.5%, W: from 3.5 to 4.5%, Ta: from 3.0 to 5.5%, Al: from 3.5 to 4.5%, Ti: from 2.2 to 3.2%, C: from 0.06 to 0.12%, B: from 0.005 to 0.025%, Zr: from 0.010 to 0.050%, Hf: from less than 1.5%, Mg and/or Ca from 1 to 100 ppm, one, two or more of Pt: from 0.02 to 0.5%, Rh: from 0.02 to 0.5% and Re: from 0.02 to 0.5%, and the balance substantially Ni and incidental impurities.

It is also known that blades of dynamic machines, such as rotor and stator blades of gas turbines, rotor blades of hot-gas blowers and so forth, are made from columnar Ni-base heat-resistant alloy castings. Such a columnar Ni-base heat-resistant alloy casting is produced by a process having the steps of: preparing a melt of an Ni-base alloy by vacuum melting, pouring the melt into a mold of a unidirectional solidifying apparatus, and moving, while the mold is being heated to a temperature of from 1480 to 1530° C., the mold on a chill plate at a moving speed of from 200 to 350 mm/h downward through a water-cooled chilling apparatus so as to allow the columnar crystals formed on the chill plate to grow, whereby a large-size elongated cast article or a large-size elongated turbine blade of columnar Ni-base heat-resistant alloy is obtained.

In recent years, gas turbines are becoming larger in size, which has given a rise to the demand for turbine blades of greater sizes. Large-size turbine blades made of columnar Ni-base heat-resistant castings, cast from conventional Ni-base heat-resistant alloy, however, undesirably exhibit rough cast surfaces, as well as local defects in the form of convexities and concavities in the surfaces. Thus, it has been impossible to produce large-size turbine blades of Ni-base heat resistant alloys having sound cast surfaces. Roughness and local defects appearing on the outer surface of the cast large-size turbine blade do not pose any critical problem, because the surface can be smoothed and the local defects can be removed by grinding and polishing. However, no means are available for smoothing inner surfaces of large-size turbine blades formed by a core mold, nor for removing local defects on these inner surfaces. A high degree of roughness on the turbine blade inner surfaces, as well as local defects, tend to trigger a rupture and to reduce creep fatigue strength, thus impairing the reliability and life of the turbine blade.

Production of turbine blades of greater sizes, made of columnar Ni-base heat-resistant alloy casting, also tends to allow generation of a multiplicity of micro-pores in the internal structure of the columnar Ni-base heat-resistant alloy casting. Thus, it has been impossible to produce large-size turbine blades having an acceptably small number of micro-pores in the structure, from columnar Ni-base heat-resistant alloy castings. Conventionally, hot isostatic press (HIP) processing has been effectively used for reducing micro-porosity. Such HIP processing, however, could not completely remove micro-pores generated in the internal structure of the columnar Ni-base heat resistant alloy castings constituting large-size turbine blades. Micro-pores remaining in the internal structure also serves to trigger a rupture and reduces creep fatigue strength, thus impairing the reliability of the large-size turbine blade.

It has also been recognized that production of columnar Ni-base heat-resistant alloy casting, in particular a large-size turbine blade, from a conventional Ni-base heat-resistant alloy tends to allow coarsening of crystal grains, causing a heavy segregation of the alloy components, with the results that intergranular corrosion rapidly proceeds at the grain boundaries where the segregation is most notable. Thus, reliability and life of large-size turbine blades made of a columnar Ni-base heat-resistant alloy casting are impaired due to a serious reduction in the resistance to intergranular corrosion at high temperature.

The segregation of the alloy components, which occurs in large-size turbine blade made of a columnar Ni-base heat-resistant alloy casting of a known Ni-base heat-resistant alloy, also causes a reduction in the mechanical strength. It is therefore necessary to conduct a solid-solution treatment at a temperature higher than that conventionally adopted, so as to promote dissolution of γ' phase which is a precipitation strengthening phase, followed by an aging treatment which causes the γ' phase to be precipitated and dispersed finely. Solid-solution treatment of a columnar crystalline casting of a conventional Ni-base heat-resistant alloy, when conducted at a temperature higher than that used in the known art, causes a local melting of the casting, so that the mechanical strength is seriously impaired, seriously impairing reliability and life of a large-size turbine blade made from such a columnar crystalline Ni-base heat-resistant alloy casting.

SUMMARY OF THE INVENTION

Under these circumstances, the inventors have made an intense study in order to develop an Ni-base heat-resistant alloy for casting which would provide better quality surfaces of cast articles and reduced generation of micro-pores inside the structure, with an aim to obtain highly reliable and long durable large-size turbine blades by casting from the developed Ni-base heat-resistant alloy.

As a result, the inventors have found that a columnar Ni-base heat resistant alloy casting exhibits highly smooth cast surfaces, as well as substantially no, or extremely few, local defects and micro-pores which would trigger a rupture, when the columnar Ni-base heat resistant alloy casting is produced by a process which comprises the steps of: preparing a melt of an Ni-base heat-resistant alloy having a composition which contains, by weight, Cr: from 12.0 to 14.3%, Co: from 8.5 to 11.0%, Mo: from 1.0 to 3.5%, W: from 3.5 to 6.2%, Ta: from 3.0 to 5.5%, Al: from 3.5 to 4.5%, Ti: from 2.0 to 3.2%, C: from 0.04 to 0.12%, B: from 0.005 to 0.05%, and the balance substantially Ni and incidental impurities; pouring the melt of the alloy into a mold of a uni-directional solidifying apparatus, and slowly lowering a chill plate at a speed of 100 to 350 mm/h, while the mold temperature is maintained at a temperature in the range of 1480 to 1650° C., higher than that employed in the known art.

The present inventors also have made a study to achieve greater strength and longer life of large-size cast turbine blades, and discovered that the local melting of an Ni-base alloy is largely affected by the presence of Zr in the alloy composition.

As a result, the inventors have found that a columnar Ni-base heat resistant alloy casting exhibits improved mechanical strength, as well as extended life, when the columnar Ni-base heat resistant alloy casting is produced by a process which comprises the steps of: preparing a melt of an Ni-base heat-resistant alloy having a composition which is free of Zr and which contains, by weight, Cr: from 12.0 to 14.3%, Co: from 8.5 to 11.0%, Mo: from 1.0 to 3.5%, W: from 3.5 to 6.2%, Ta: from 3.0 to 5.5%, Al: from 3.5 to 4.5%,Ti: from 2.0 to 3.2%, C: from 0.04 to 0.12%, B: from 0.005 to 0.05%, and the balance substantially Ni and incidental impurities; pouring the melt of the alloy into a mold of a uni-directional solidifying apparatus, slowly lowering a chill plate while the mold temperature is maintained at a higher temperature than that employed in the known art, so as to obtain columnar Ni-base heat-resistant alloy casting, subjecting, as required, the columnar Ni-base heat-resistant alloy casting to hot isostatic pressing (HIP) which consists in holding the casting at a temperature of from 1180 to 1265° C. under a pressure of from 900 to 1600 atm., for a time period of from 1 to 5 hours, subjecting the casting to a solid-solution treatment which consists in holding the casting for a time period of from 2 to 5 hours at a temperature falling within a temperature in the range of 1200 to 1265° C., higher than the temperatures adopted conventionally, and subjecting the casting to aging which includes holding the casting at a temperature of from 950 to 180° C. for 2 to 10 hours and a subsequent holding of the casting at a temperature of from 750 to 880° C. for 16 to 24 hours. Thus, the inventors have found that large-size turbine blades made of this columnar Ni-base heat-resistant alloy exhibit improved strength and life over the known arts. Free of Zr means that the alloy contains less than 0.001 ppm of Zr.

The present inventors also have made a study to improve resistance to intergranular corrosion of large-size cast turbine blades at high temperature, and discovered that the a columnar Ni-base heat-resistant alloy casting exhibits improved resistance to intergranular corrosion at high temperature, when the columnar Ni-base heat-resistant alloy casting is produced by a process which comprises the steps of: preparing a melt of an Ni-base heat-resistant alloy having a composition in which the Zr content is limited to trace amounts and which contains, by weight, Cr: from 12.0 to 14.3%, Co: from 8.5 to 11.0%, Mo: from 1.0 to 3.5%, W: from 3.5 to 6.2%, Ta: from 3.0 to 5.5%, Al: from 3.5 to 4.5%, Ti: from 2.0 to 3.2%, C: from 0.04 to 0.12%, B: from 0.005 to 0.05%, Zr: from 0.001 to 5 ppm, and the balance substantially Ni and incidental impurities; lowering a chill plate while pouring the melt of the alloy into a mold of a uni-directional solidifying apparatus, so as to obtain a columnar Ni-base heat-resistant alloy casting, subjecting the columnar Ni-base heat-resistant alloy casting to HIP which includes holding the casting at a temperature of from 1180 to 1265° C. under a pressure of from 900 to 1600 atm., for a time period of from 1 to 5 hours, subjecting the casting to a solid-solution treatment which includes holding the casting for a time period of from 2 to 5 hours at a temperature falling within a temperature in the range of from 1200 to 1265° C., higher than the temperatures adopted conventionally, and subjecting the casting to aging which includes holding the casting at a temperature of from 950 to 1080° C. for 2 to 10 hours and a subsequent holding of the casting at a temperature of from 760 to 870° C. for 16 to 24 hours. Thus, the inventors have found that large-size turbine blades made of this columnar Ni-base heat-resistant alloy exhibits higher resistance to intergranular corrosion over the known arts.

The present invention is based upon these discoveries, and includes an Ni-base heat-resistant alloy for a casting having sound surfaces and internal structure, the alloy having a composition which contains, by weight, Cr: from 12.0 to 14.3%, Co: from 8.5 to 11.0%, Mo: from 1.0 to 3.5%, W: from 3.5to 6.2%, Ta: from 3.0 to 5.5%, Al: from 3.5 to 4.5%, Ti: from 2.0 to 3.2%, C: from 0.04 to 0.12%, B: from 0.005 to 0.05%, and the balance substantially Ni and incidental impurities. This Ni-base heat resistant alloy may further contain Mg and/or Ca: from 1 to 100 ppm and/or one, two or more of Pt: from 0.02 to 0.5%, Rh: from 0.02 to 0.5% and Re: from 0.02 to 0.5%.

A large-size casting of a columnar Ni-base heat-resistant alloy, having sound cast surfaces and internal structure, can be obtained by preparing a melt of an Ni-base heat-resistant alloy of the type stated above, pouring the melt into a mold of a uni-directional casting apparatus, and pulling downward a chill plate at a speed of from 100 to 350 mm/h at a temperature of from 1480 to 1650° C. Thus, the present invention also includes a large-size casting of the Ni-base heat resistant alloys.

A large-size cast turbine blade formed of a large-size casting of a columnar Ni-base heat-resistant alloy, having sound cast surfaces and internal structure, can be obtained by preparing a melt of an Ni-base heat-resistant alloy of the type stated above, pouring the melt into a mold of a uni-directional casting apparatus, and pulling downward a chill plate at a speed of from 100 to 350 mm/h at a temperature of from 1480 to 1650° C. Thus, the present invention also includes a large-size cast turbine blade of the columnar Ni-base heat-resistant alloys.

DETAILED DESCRIPTION OF THE INVENTION

The Ni-base heat-resistant alloy capable of providing sound cast surfaces and internal structure as stated above, the large-size columnar Ni-base heat resistant alloy casting having sound cast surfaces and internal structure as stated above, and the large-size cast turbine blade of columnar Ni-base heat-resistant alloy having sound cast surfaces and internal structure as stated above, are preferably subjected to one or more of: HIP conducted for 2 to 5 hours at 1180 to 1265° C. under a pressure of 900 to 1600 atm.; a solid-solution treatment conducted at a temperature of from 1200 to 1265° C.; and a two-staged aging heat treatment including a first stage of holding the casting at a temperature of from 950 to 1080° C. for a period of time of from 2 to 10 hours, and a second stage of holding the casting at a temperature of from 750 to 880° C. for a period of time of from 16 to 24 hours. These series of steps serve to further improve the mechanical strength. Preferably, the solid-solution treatment is preceded by HIP.

The method of the invention for producing a large-size cast article of a columnar Ni-base heat-resistant alloy is suitable particularly for use in the production of large-size turbine blades. Thus, the present invention also includes a method of producing a large-size cast turbine blade of a columnar Ni-base heat-resistant alloy, comprising the steps of: preparing a large-size turbine blade casting of the columnar Ni-base heat resistant alloy, subjecting the turbine blade casting to a solid-solution treatment conducted at a temperature of from 1200 to 1265° C., and then to a two-staged aging heat treatment including a first stage of holding the casting at a temperature of from 950 to 1080° C. for a period of time of from 2 to 10 hours, and a second stage of holding the casting at a temperature of from 750 to 880° C. for a period of time of from 16 to 24 hours. Preferably, the solid-solution treatment is preceded by HIP.

The present invention also provides a large-size cast article of the columnar Ni-base heat-resistant alloy as well as a large-size cast turbine blade of the columnar Ni-base heat-resistant alloy having a composition which contains, by weight, Cr: from 12.0 to 14.3%, Co: from 8.5 to 11.0%, Mo: from 1.0 to 3.5%, W: from 3.5 to 6.2%, Ta: from 3.0 to 5.5%, Al: from 3.5 to 4.5%, Ti: from 2.0 to 3.2%, C: from 0.04 to 0.12%, B: from 0.005 to 0.05%, and the balance substantially Ni and incidental impurities. More preferably, the contents of the elements Cr, Co, Mo, W, Ta, Al, Ti, C and B in the Ni-base heat-resistant alloy constituting the large-size cast article and the large-size cast turbine blade are as follows: Cr: from 12.5 to 14%, Co: from 9.4 to 10.6%, Mo: from 1.2 to 2.0%, W: from 4.2 to 5.8%, Ta: from 4.0 to 5.2%, Al: from 3.8 to 4.4%, Ti: from 2.2 to 3.0%, C: from 0.05 to 0.09%, and B: from 0.008 to 0.03%, with the balance substantially Ni and incidental impurities.

The present invention also provides a large-size cast article of the columnar Ni-base heat-resistant alloy having high resistance to intergranular corrosion at high temperature, having a composition which contains: Cr: from 12.0 to 14.3%, Co: from 8.5 to 11.0%, Mo: from 0.5 to 4%, W: from 3.5 to 6.2%, Ta: from 3.0 to 5.5%, Al: from 3.5 to 4.5%, Ti: from 2.0 to 3.2%, C: from 0.04 to 0.12%, B: from 0.005 to 0.05%, Zr: from 0.001 to 5 ppm, and the balance substantially Ni and incidental impurities. Preferably, the composition of the Ni-base heat-resistant alloy of the large-size cast article having high resistance to intergranular corrosion at high temperature contains, by weight, Cr: from 13 to 14%, Co: from 9.4 to 10.6%, Mo: from 1.2 to 2.0%, W: from 4.2 to 5.8%, Ta: from 4.0 to 5.2%, Al: from 3.8 to 4.4%, Ti: from 2.2 to 3.0%, C: from 0.05 to 0.09%, B: from 0.008 to 0.03%, Zr: from 0.01 to 1 ppm, and the balance substantially Ni and incidental impurities.

The columnar Ni-base heat-resistant alloy of the present invention, having high resistance to intergranular corrosion at high temperature, is suitable particularly for use as the material of large-size turbine blades. The present invention therefore also includes a large-size cast turbine blades made of a casting of a columnar Ni-base heat-resistant alloy having high resistance to interganular corrosion at high temperature, the alloy having a said alloy having a composition which contains, by weight, Cr: from 12.0 to 14.3%, Co: from 8.5 to 11.0%, Mo: from 1.0 to 3.5%, W: from 3.5 to 6.2%, Ta: from 3.0 to 5.5%, Al: from 3.5 to 4.5%, Ti: from 2.0 to 3.2%, C: from 0.04 to 0.12%, B: from 0.005 to 0.05%, Zr: from 0.001 to 5 ppm and the balance substantially Ni and inevitable impurities. Preferably, the columnar Ni-base alloy constituting the large-size turbine blade of columnar Ni-base heat-resistant alloy having high resistance to intergranular corrosion at high temperature has a composition which contains, by weight, Cr: from 13 to 14%, Co: from 9.4 to 10.6%, Mo: from 1.2 to 2.0%, W: from 4.2 to 5.8%, Ta: from 4.0 to 5.2%, Al: from 3.8 to 4.4%, Ti: from 2.2 to 3.0%, C: from 0.05 to 0.09%, B: from 0.008 to 0.03%, Zr: from 0.01 to 1 ppm, and the balance substantially Ni and incidental impurities.

This columnar Ni-base heat resistant alloy having high resistance to intergranular corrosion at high temperature may further contain Mg and/or Ca: from 1 to 100 ppm and/or one, two or more of Pt: from 0.02 to 0.5%, Rh: from 0.02 to 0.5% and Re: from 0.02 to 0.5%. The columnar Ni-base heat-resistant alloy having high resistance to intergranular corrosion at high temperature, containing Mg and/or Ca, and/or one, two or more of Pt, Rh and Re, is suitable particularly for use as a material of large-size turbine blades.

A description will now be given of the reasons for the specific contents of the constituent elements in the Ni-base heat-resistant alloy of the present invention capable of providing sound cast surfaces and internal structure, as well as in the large-size cast article and large-size turbine blade made of the columnar Ni-base heat-resistant alloy capable of presenting sound cast surfaces and internal structure of a casting cast from this alloy.

Cr

Components or parts of a gas turbine for industrial use is required to have high resistance to oxidation, as well as high resistance to corrosion, at high temperatures, because they contact combustion gases containing oxidizing and corrosive gases. Cr is an element which provides resistance to oxidation and corrosion. The anti-oxidation and anti-corrosion effects are enhanced as the content of Cr increases. These effects, however, are not appreciable when the Cr content is less than 12.0%. The Ni-base heat-resistant alloy of the invention, which can provide sound cast surfaces and internal structure, essentially contain elements such as Co, Mo, W, Ta and so forth. In order to obtain a good balance with these elements, it is not preferred that Cr is contained in excess of 14.3%. The Cr content, therefore, is specified as from 12.0% to 14.3%. In order to ensure that sound cast surfaces and internal structure are obtained, it is preferred that the Cr content of the Ni-base heat-resistant alloy ranges from 12.5 to 14.0%.

Co

Co is an element which increases the limit of dissolution (limit of solid-solution) of elements such as Ti, Al, Ta or the like in the matrix, so as to allow fine dispersion and precipitation of γ' phase ($Ni_3$(Ti, Al, Ta)), thus contributing enhancement of strength of the Ni-base heat-resistant alloy which can provide sound cast surfaces and internal structure. In order that such effect is appreciable, it is necessary that the Co content is 8.5% or greater. On the other hand, Co content exceeding 11.0% impairs the balance between Co and other elements such as Cr, Mo, W, Ta, Al and Ti, so as to cause deterioration in the ductility due to precipitation of noxious components. The Co content is therefore specified as from 8.5 to 11.0%. In order to ensure that sound cast surfaces and internal structure are obtained, it is preferred that the Co content of the Ni-base heat-resistant alloy ranges from 9.4 to 10.6%.

Mo

Mo is an element which is dissolved in the matrix so as to enhance the strength at high temperature. This element also enhances the strength at high temperature through precipitation hardening effect. These effects are not notable when the Mo content is less than 1.0%, while Mo content exceeding 3.5% allows precipitation of noxious phases so as to impair the ductility. For these reasons, the Mo content is specified as from 1.0 to 3.5%. In order to ensure that sound cast surfaces and internal structure are obtained, it is preferred that the Mo content of the Ni-base heat-resistant alloy ranges from 1.2 to 2.0%.

W

W is an element which provides solid-solution strengthening effect and precipitation hardening effect, as is the case of Mo. In order to obtain appreciable effects, the W content should be 3.5% or greater. A too large W content, however, allows precipitation of noxious phases and increases the specific weight of the whole alloy because this element itself has a large specific weight. Such a large specific weight is disadvantageous for the turbine rotor blade which has to sustain a large centrifugal force. A large W content also allows generation of Freckle defects during casting of a large-size cast article having columnar crystalline structure, and elevates the cost of production. The content of W, therefore, should fall within the range of from 3.5 to 6.2%. In order to ensure that sound cast surfaces and internal structure are obtained, it is preferred that the W content of the Ni-base heat-resistant alloy ranges from 4.2 to 5.8%.

Ti

Ti is an element which is necessary for causing precipitation of γ' phase which serves to strengthen at high temperatures γ' precipitation hardening Ni-base alloys. A Ti content less than 2.0% cannot provide sufficient strengthening effect caused by precipitation of γ' phase. A Ti content greater than 3.2% causes an excessively heavy precipitation, thus impairing ductility. In addition, such a large Ti content allows too vigorous a reaction between the casting and the mold, so as to deteriorate the quality of the cast surfaces. For these reasons, the Ti content should range from 2.0 to 3.2%. In order to ensure that sound cast surfaces and internal structure are obtained, it is preferred that the Ti content of the Ni-base heat-resistant alloy ranges from 2.2 to 3.0%.

Al

Al produces effects similar to those brought about by Ti. Namely, Al generates γ' phase so as to increase the strength at high temperature, while improving resistance to oxidation and corrosion. In order that these effects are appreciable, the Al content should be not less than 3.5%. On the other hand, an Al content exceeding 4.5% impairs the ductility. For these reasons, the Al content should fall within the range of from 3.5 to 4.5%. In order to ensure that sound cast surfaces and internal structure are obtained, it is preferred that the Al content of the Ni-base heat-resistant alloy ranges from 3.8 to 4.4%.

Ta

Ta is an element which contributes to improvement in the strength at high temperature, through solid-solution strengthening and γ' phase precipitation hardening. In order to obtain appreciable effects, the content of this element should be 3.0% or greater. However, a too large content of this element undesirably impairs the ductility, so that the content of this element is specified as not greater than 5.5%. For these reasons, the Ta content of the Ni-base heat-resistant alloy capable of providing sound cast surfaces and internal structure should range from 3.0 to 5.5%, preferably from 4.0 to 5.4%.

C

C is a carbide former to allow precipitation of carbides at the grain boundaries and inter-dendritic regions so as to enhance the strength at the grain boundaries and interdendritic regions, thus contributing to enhancement of the strength at high temperature. In order to obtain an appreciable effect, it is necessary that the C content is not less than 0.04%. This element, however, undesirably impairs the ductility when its content exceeds 0.12%. Therefore, the C content is selected to range from 0.04 to 0.12%, preferably from 0.05 to 0.09%.

B

B is an element which increases the strength at grain boundaries so as to increase the strength at high temperature, by enhancing the interganular bonding force. A B content less than 0.005% cannot provide the desired effect, whereas a too large B content serves to impair the ductility. The B content, therefore, should be 0.005% or more. Preferably, the B content ranges from 0.006 to 0.03%.

Zr

Zr, when it is present in a trace amount, serves to increase the intergranular corrosion so as to improve the intergranular corrosion resistance at high temperature. To this end, the Zr content should be 0.001 ppm or greater. Conversely, addition of Zr in excess of 5 ppm causes a heavy segregation of Zr at grain boundaries, which undesirably reduces the corrosion resistance at grain boundaries and lowers the melting temperature of local portions of the cast article. This undesirably serves to prohibit elevation of solid-solution treatment temperature effected for the purpose of micro-fine dispersion of precipitating strengthening phases. Solid-solution heat treatment, when conducted at an elevated temperature which is necessary for micro-fine dispersion of precipitation strengthening phases while neglecting local reduction of the melting temperature, causes cracking of the casting. For these reasons, the Zr content is specified as from 0.001 to 5 ppm. Preferably, the Zr content falls within the range of from 0.01 to 1 ppm.

Mg and/or Ca

Mg and Ca exhibit a large bonding force to impurities such as oxygen, sulfur and so forth, and effectively suppress reduction in the ductility which is caused by the inclusion of the impurities such as oxygen and sulfur. These effects, however, are not appreciable when the content of Mg and/or Ca is less than 1 ppm, whereas inclusion of Mg and/or Ca in excess of 100 ppm weakens the bonding at the grain boundaries so as to cause cracking. For these reasons, the content of Mg and/or Ca is specified as from 1 to 100 ppm.

Pt, Rh, Re

Each of Pt, Rh and Re provides an anti-corrosion effect. The effect, however, is not appreciable when the content is below 0.02%. A content exceeding 0.5% also fails to provide the desired effect and, moreover, the cost is increased because each of these elements is a precious metal. For these reasons, the content of each of Pt, Rh and Re, when one, two or more of them are used, is specified as from 0.02 to 0.5%.

Other Elements

Conventional large-size casting of columnar Ni-base heat-resistant alloy essentially contains Hf. In contrast, the large-size casting of columnar Ni-base heat-resistant alloy in accordance with the present invention preferably does not contain Hf. Therefore, the alloy is preferably Hf free. Free of Hf means that the alloy contains less than 0.001 ppm of Hf.

A description will now be given of the method of producing a large-size cast article, as well as a large-size cast turbine blade, of a columnar Ni-base heat-resistant alloy in accordance with the present invention. The method employs as the material an Ni-base heat-resistant alloy having constituent elements the contents of which are determined to fall substantially within the same ranges as those described before in connection with the Ni-base heat-resistant alloy capable of providing sound cast surfaces and internal structure.

Conditions for HIP

Preferably, the method of the invention for producing a large-size cast article, as well as a large-size cast turbine blade, of columnar Ni-base heat-resistant alloy in accordance with the present invention employs the step of effecting HIP. Preferably, HIP is performed by holding the casting for a period of 1 to 5 hours at a temperature of from 1180 to 1265° C. under a pressure of from 900 to 1600 atm. A pressure higher than 1600 atm. may be employed without causing any detrimental effect on the quality of the cast article as the product material, but a pressure exceed 1600 atm. is uneconomical.

Conditions for Solid-solution Heat-treatment

In the method of the present invention for producing a large-size cast article or a large-size cast turbine blade of columnar Ni-base heat-resistant alloy, the solid-solution heat-treatment is conducted for the purpose of promoting dissolution of the γ' phase which is a precipitation strengthening phase, so as to ensure micro-fine dispersion of the γ' phase through an aging treatment which is to be conducted subsequently. The solid-solution heat treatment, when conducted at a temperature below 1200° C., cannot provide satisfactory dissolution of the γ' phase, while the solid-solution heat treatment when conducted at a temperature exceeding 1265° C. causes local melting of the casting. Such a locally molten portion causes a microscopic defect, with the result that the fatigue strength is undesirably reduced. In the method of the present invention for producing a large-size cast article or a large-size turbine blade of a columnar Ni-base heat-resistant alloy, the temperature of the solid-solution heat treatment should fall within the range of from 1200 to 1265° C. The period of time over which the casting is held preferably ranges from 2 to 5 hours, although the time depends on the size of the cast article or the turbine blade.

Conditions for Two-staged Aging Treatment

The method of the present invention for producing a large-size cast article or a large-size cast turbine blade of columnar Ni-base heat-resistant alloy employs a two-staged aging treatment which includes a first stage executed by holding the casting for a period of from 2 to 10 hours at a temperature of from 950 to 1080° C., which is higher than the conventionally adopted aging temperature (843° C.), and a subsequent second stage in which the casting is held for 16 to 24 hours at a temperature of from 750 to 880° C., which is substantially the same as that employed conventionally. The reason why the first stage is conducted for 2 to 10 hours at a temperature of from 950 to 1080° C. is that the aging when conducted for a time less than 2 hours at a temperature 950° C. does not provide sufficient aging effect, while the aging when conducted for a time exceeding 10 hours at a temperature higher than 1080° C. renders the particle size of the precipitated γ' phase so as to disadvantageously lower the strength.

Thus, the method of the present invention for producing a large-size cast article or a large-size cast turbine blade of columnar Ni-base heat-resistant alloy comprises the steps of: preparing a large-size casting or a large-size turbine blade casting of a columnar Ni-base heat-resistant alloy by using a uni-directional solidifying apparatus, by pulling a chill plate at a speed of 200 to 350 mm/h while the mold temperature is held within a range of from 1480 to 1630° C., conducting, as required, HIP by holding the casting for 1 to 5 hours at a temperature of 1180 to 1265° C. under a pressure of from 900 to 1600 atm., conducting a solid-solution heat treatment by holding the casting for 2 to 5 hours at a temperature of from 1200 to 1265° C. and subjecting the casting to a two-staged aging heat treatment having a first stage of holding the casting for 2 to 10 hours at a temperature of from 950 to 1080° C. and a second stage of holding the casting for 16 to 24 hours at a temperature of from 750 to 880° C.

Referring now to the large-size cast article, as well as to the large-size cast turbine blade, of columnar Ni-base heat-resistant alloy having high resistance to intergranular corrosion at high temperature, the constituent elements and their contents are substantially the same as those described before in connection with the Ni-base heat resistant alloy capable of providing sound cast surfaces and internal structure.

The Cr content, is specified as from 12.0% to 14.3%. In order to ensure that sound cast surfaces and internal structure are obtained, it is preferred that the Cr content of the Ni-base heat-resistant alloy ranges from 12.5 to 14.0%. The Ta content of the Ni-base heat-resistant alloy capable of providing sound cast surfaces and internal structure should range from 3.0 to 5.5%, preferably from 4.0 to 5.2%. The B content, should be 0.005% or more. Preferably, the B content ranges from 0.008 to 0.03%.

The large-size cast article of columnar Ni-base heat-resistant alloy, having high resistance to intergranular corrosion at high temperature, can be produced by a process which comprises the steps of: preparing a large-size casting or a large-size turbine blade casting of a a columnar Ni-base heat-resistant alloy by using a uni-directional solidifying apparatus, by pulling a chill plate at a speed of 200 to 350 mm/h while the mold temperature is held within a range of from 1480 to 1530° C., conducting an HIP by holding the casting for 1 to 5 hours at a temperature of 1180 to 1265° C. under a pressure of from 900 to 1600 atm., conducting a solid-solution heat treatment by holding the casting for 2 to 5 hours at a temperature of from 1200 to 1265° C. and subjecting the casting to a two-staged aging heat treatment having a first stage of holding the casting for 2 to 10 hours at a temperature of from 950 to 1080° C. and a second stage of holding the casting for 16 to 24 hours at a temperature of from 760 to 870° C.

EXAMPLES

Having generally described this invention, a further understanding can be obtained by reference to certain specific examples which are provided herein for purposes of illustration only and are not intended to be limiting unless otherwise specified.

Example 1

Sample Nos. 1 to 24 of the Ni-base heat-resistant alloy of the present invention, as well as Comparative Sample Nos.

1 to 4 of conventional Ni-base heat-resistant alloys, were prepared to have compositions as shown in Tables 1 to 4. Gas turbine rotor blades of 250 mm long were fabricated by precision casting from these alloys, using a composite gas turbine blade mold constituted by a core mold part containing not less than 97% of silica and an outer mold part containing silica as a binder.

More specifically, the Sample Nos. 1 to 24 of the Ni-base heat-resistant alloy of the invention and Comparative Sample Nos. 1 to 4 of conventional Ni-base heat-resistant alloy were melted under a vacuum and the melt of each alloy was held at a temperature of 1570° C. The composite mold for casting the gas turbine blade was heated to 1520° C. and was placed on a chill plate of a uni-directional solidifying apparatus, and uni-directional solidification casting was executed by pulling the chill plate downward at a speed of 220 mm/h, whereby a columnar crystalline casting as the material of gas-turbine blade was obtained from each of the alloys. Each columnar crystalline casting as the material of a gas-turbine rotor blade, having a blade length of 250 mm, was taken out by dismantling the mold. The turbine blade casting thus obtained was subjected to a sand blast for the purpose of removing mold material from the outer surface of the casting, and then to leaching (an operation in which a casting is immersed in an alkali solution and held in a pressure vessel so as to dissolve and remove a core mold part in the casting) conducted for a period of 24 hours.

Fluorescent flaw detection was executed on the outer surfaces of the columnar crystalline castings as the materials of the gas turbine rotor blade castings prepared from Sample Nos. 1 to 24 of the Ni-base heat-resistant alloy of the invention and from Comparative Sample Nos. 1 to 4 of conventional Ni-base heat-resistant alloy. The numbers of concave or recess defects of sizes not smaller than 0.2 mm were measured on the rotor blade castings to obtain the results as shown in Tables 5 to 8. Each of the columnar crystalline turbine blade castings made of Sample Nos. 1 to 24 of the Ni-base heat-resistant alloy of the present invention and Comparative Sample Nos. 1 to 4 of the conventional alloy was cut at its central portion, and photographs are taken of the outer cast surface which contacted the outer mold part and the inner cast surface which contacted the silica core mold at magnifications of 25 and 100. The maximum size of convexities and concavities were measured from the photograph of magnification 25, and the number of micro-pores existing in the structure of casting per 1 $mm^2$ was counted from the photograph of magnification 100. The results are shown in Tables 5 to 8.

From the results shown in Tables 1 to 8, it is understood that the columnar crystalline cast turbine blades produced from the Sample Nos. 1 to 24 of the Ni-base heat-resistant alloy of the present invention exhibit fewer concave defects as compared with those produced from the Comparative Sample Nos. 1 to 4 of the conventional Ni-base heat-resistant alloy, as demonstrated by the results of the fluorescent flaw detection. In addition, the columnar crystalline cast turbine blades produced from the Sample Nos. 1 to 24 of the Ni-base heat-resistant alloy of the present invention have smaller maximum sizes of convexities and concavities, as well as fewer numbers of micro-pores, as compared with those produced from the Comparative Sample Nos. 1 to 4 of the conventional Ni-base heat-resistant alloy. It is therefore understood that the columnar crystalline cast turbine blades produced from the Sample Nos. 1 to 24 of the Ni-base heat-resistant alloy of the present invention are superior to those produced from the Comparative Sample Nos. 1 to 4 of the conventional Ni-base heat-resistant alloy, in terms of the soundness of the cast surfaces and internal structure.

Thus, the Ni-base heat-resistant alloy in accordance with the present invention can provide large-size cast articles or turbine blades of Ni-base heat resistant alloy having higher degree of soundness of cast surfaces and internal structure, so that the large-size articles or large-size turbine blades can have improved reliability and can stand a longer use over the known arts, thus offering a great industrial advantage.

Example 2

Samples of Ni-base heat-resistant alloys having compositions as shown in Tables 9 to 11 were prepared and were melted under a vacuum. Each sample alloy was poured into a mold of a uni-directional solidifying apparatus and casting was conducted in this mold. During the casting, the mold was heated to and maintained at 1600° C., while the chill plate was pulled downward at a speed of 120 mm/h, whereby columnar crystalline cast plates A to P and a to d, each having a thickness of 15 mm, width of 100 mm and a length of 300 mm, were prepared. The columnar crystalline cast plates A to P were made of Ni-base heat-resistant alloys having compositions free of Zr, while the columnar crystalline cast plates a to d were made of alloys having compositions containing Zr.

Each of the columnar crystalline cast plates A to P and a to d thus prepared was subjected to a solid-solution treatment which consisted of holding each plate under the conditions shown in Tables 12 and 13 and subsequent cooling by an Ar gas blower. Each plate was then subjected to a first-stage aging treatment in which the plate was held in vacuum under the conditions shown in Tables 12 and 13 and then cooled by an Ar gas blower, and to a second-stage aging in which the plate was held in vacuum under the conditions shown in Tables 12 and 13 and then cooled by an Ar gas blower, whereby sample plates of Sample Nos. 1 to 16 of the columnar crystalline cast plate in accordance with the method of the present invention, as well as sample plates of Comparative Sample Nos. 17 to 20 produced by comparative example methods, were obtained.

The columnar crystalline cast plates of Sample Nos. 1 to 16 in accordance with the present invention and Comparative Sample Nos. 17 to 20 as comparative examples, made of the columnar crystalline cast plates A to P and a to d, were observed through an optical microscope at a magnification of 500, for the purpose of examination of the microscopic structures to find any local melting. A substantially cylindrical test piece having a diameter of 6 mm as measured at its parallel portion was cut by machining out of each of the columnar crystalline cast plates A to P and a to d, and was subjected to a high-temperature creep rupture test in which the test piece was held at 960° C. under the load of 22 $Kg/mm^2$ and the length of time till rupture was measured. The results of the microscopic observation and high-temperature creep rupture test are shown in Tables 12 and 13.

From the results shown in Tables 9 to 13, it is understood that the columnar crystalline cast plates of Sample Nos. 1 to 16, produced from the Zr-free columnar crystalline cast plates A to P through a solid-solution heat treatment conducted at higher temperatures than in the conventional methods and a subsequent first-stage aging heat treatment, showed no local melting and exhibited superior high-temperature creep rupture strength. In contrast, the columnar crystalline cast plates of Comparative Sample Nos. 17 to 20, produced from the Zr-containing columnar crystalline cast plates a to d through a solid-solution heat treatment conducted at higher temperatures than in the conventional methods and a subsequent first-stage aging heat treatment, showed local melting and exhibited inferior high-temperature creep rupture strength.

Example 3

The columnar crystalline cast plates A to P and a to d shown in Tables 9 to 11 were subjected to HIP conducted in an Ar atmosphere under the conditions shown in Tables 14 and 15. The cast plates A to P and a to d were then subjected to a solid-solution treatment consisting in holding the plates under the conditions shown in Tables 14 and 15 and subsequent cooling by an Ar gas blower. The cast plates A to P and a to d were then subjected to a two-staged aging treatment having a first stage consisting in holding the plates under the conditions of Tables 14 and 15 in a vacuum atmosphere and subsequent cooling by an Ar gas blower, and a second stage consisting in holding the plates under the conditions shown in Tables 14 and 15 in a vacuum atmosphere and subsequent Ar gas blowing, thus executing Sample Nos. 21 to 36 of the method in accordance with the present invention and Comparative Sample Nos. 37 to 40 of the comparative example methods. The columnar crystalline cast plates A to P and a to d, treated in accordance with Sample Nos. 21 to 36 and Comparative Sample Nos. 37 to 40, were checked for the presence of local melting, and the lengths of time till rupture were measured under the same conditions as Example 2, for the purpose of evaluating creep rupture strength at high temperature. The results are also shown in Tables 14 and 15.

From the results shown in Tables 9 to 11, 14 and 15, it is understood that the columnar crystalline cast plates obtained through Sample Nos. 21 to 36 of the method of the present invention, produced from the Zr-free columnar crystalline cast plates A to P through HIP, a solid-solution heat treatment conducted at higher temperatures than in the conventional methods and a subsequent first-stage aging heat treatment, showed no local melting and exhibited superior high-temperature creep rupture strength. In contrast, the columnar crystalline cast plates fabricated through Comparative Sample Nos. 37 to 40 of the comparative example method, produced from the Zr-containing columnar crystalline cast plates a to d through a solid-solution heat treatment conducted at higher temperatures than in the conventional methods and a subsequent first-stage aging heat treatment, showed local melting and exhibited inferior high-temperature creep rupture strength.

Example 4

Ni-base heat-resistant alloys having compositions as shown in Tables 16 to 18 were prepared. The alloys were melted under a vacuum and the melts of the Ni-base heat-resistant alloy thus obtained were poured into molds of a uni-directional solidifying apparatus and was molded in the mold at a chill plate lowering speed of 120 mm/h and a mold heating temperature of 1600° C., so as to become columnar crystalline large-size cast plates Sample Nos. 1 to 16 in accordance with the present invention and columnar crystalline large-size cast plates Comparative Sample Nos. 17 to 20 of conventional arts, each having a thickness of 15 mm, width of 100 mm and a length of 300 mm.

The Sample Nos. 1 to 16 of the large-size columnar crystalline cast plates in accordance with the present invention, as well as Comparative Sample Nos. 17 to 20 of the large-size cast plates of conventional columnar crystalline alloys, were subjected to HIP consisting in holding the plates in an Ar atmosphere for 2 hours at a temperature of 1180° C. under 1500 atm., a solid-solution heat treatment consisting in holding the plates in a vacuum for 2 hours at a temperature of 1240° C. and subsequent cooling by an Ar gas blower, and were then subjected to a two-staged aging heat treatment having a first stage consisting in holding the plates in vacuum for 5 hours at a temperature of 1050° C. and subsequent cooling by an Ar gas blower, and a second stage consisting in holding the plates for 18 hours at 870° C. and subsequent cooling by an Ar gas blower.

Test pieces of 10 mm in diameter and 20 mm in length were cut by machining out of the Sample Nos. 1 to 16 of the large-size columnar crystalline large-size plates in accordance with the present invention and the Comparative Sample Nos. 17 to 20 of the large-size cast plates of conventional columnar crystalline alloy, all these samples having undergone HIP and subsequent heat treatments stated above. The test pieces thus obtained were immersed in a bath of molten salt at 950° C. ($Na_2SO_4$: 20 wt %, NaCl: 5 wt %, $Na_2CO_3$: 75 wt %) and, after being taken out of the molten salt bath, shelved for 150 hours in an electric oven maintaining an atmosphere of 900° C., followed by cooling. Each of the test piece was cut for observation of the microscopic structure through an SEM (scanning electron microscope) observation. Average depth of corrosion progressed along the grain boundaries was measured for each test piece, for the purpose of evaluation of resistance to intergranular corrosion at high temperatures. The results are shown in Table 19.

From the results shown in Tables 16 to 19, it is understood that the Sample Nos. 1 to 16 of the large-size columnar crystalline cast plates in accordance with the present invention has superior resistance to intergranular corrosion at high temperature, as compared with the Comparative Sample Nos. 17 to 20 of the large-size cast plate of conventional columnar crystalline alloys which are rich in Zr. It is thus clear that the large-size cast article of the columnar crystalline Ni-base heat resistance alloy in accordance with the present invention excels in the resistance to intergranular corrosion at high temperature and, therefore, can stand stable and long use, even under severe conditions of use such as those for rotor and stator blades of gas turbines and rotor blades of hot gas blowers, thus offering a great industrial advantage.

TABLE 1

| | Composition (wt %, Ca and Mg by ppm) | | | | | | | | | | | | | | |
|---|---|---|---|---|---|---|---|---|---|---|---|---|---|---|---|
| Sample No. | Cr | Co | Mo | W | Ta | Al | Ti | C | B | Ca | Mg | Pt | Rh | Re | Ni |
| Ni-base heat resistant alloy of invention | | | | | | | | | | | | | | | |
| 1 | 13.1 | 9.0 | 2.1 | 4.0 | 3.3 | 4.0 | 2.7 | 0.08 | 0.011 | — | — | — | — | — | Bal. |
| 2 | 14.0 | 8.5 | 1.0 | 3.5 | 5.4 | 3.5 | 2.3 | 0.10 | 0.009 | — | — | — | — | — | Bal. |

TABLE 1-continued

| Sample No. | Composition (wt %, Ca and Mg by ppm) | | | | | | | | | | | | | | |
|---|---|---|---|---|---|---|---|---|---|---|---|---|---|---|---|
| | Cr | Co | Mo | W | Ta | Al | Ti | C | B | Ca | Mg | Pt | Rh | Re | Ni |
| 3 | 12.5 | 10.1 | 3.5 | 4.3 | 4.9 | 4.3 | 3.2 | 0.06 | 0.007 | — | — | — | — | — | Bal. |
| 4 | 13.5 | 10.5 | 1.5 | 3.7 | 3.0 | 3.7 | 2.5 | 0.12 | 0.015 | — | — | — | — | — | Bal. |
| 5 | 13.3 | 10.1 | 1.5 | 4.5 | 4.6 | 4.1 | 2.7 | 0.06 | 0.010 | — | — | — | — | — | Bal. |
| 6 | 12.2 | 9.7 | 2.4 | 4.5 | 3.8 | 4.5 | 2.9 | 0.07 | 0.013 | — | — | — | — | — | Bal. |
| 7 | 13.3 | 8.8 | 2.7 | 5.1 | 3.5 | 4.1 | 3.0 | 0.09 | 0.012 | — | — | — | — | — | Bal. |
| 8 | 14.2 | 9.3 | 3.0 | 6.0 | 3.8 | 3.9 | 2.8 | 0.11 | 0.010 | — | — | — | — | — | Bal. |

TABLE 2

| Sample No. | Composition (wt %, Ca and Mg by ppm) | | | | | | | | | | | | | | |
|---|---|---|---|---|---|---|---|---|---|---|---|---|---|---|---|
| | Cr | Co | Mo | W | Ta | Al | Ti | C | B | Ca | Mg | Pt | Rh | Re | Ni |
| Ni-base heat resistant alloy of invention | | | | | | | | | | | | | | | |
| 9 | 13.4 | 9.5 | 1.8 | 4.2 | 4.5 | 4.2 | 2.7 | 0.08 | 0.005 | — | 72 | — | — | — | Bal. |
| 10 | 12.1 | 9.0 | 2.1 | 4.0 | 3.3 | 4.1 | 2.7 | 0.08 | 0.011 | 10 | — | — | — | — | Bal. |
| 11 | 14.0 | 8.5 | 1.1 | 3.5 | 5.3 | 3.6 | 2.2 | 0.10 | 0.039 | 20 | 30 | — | — | — | Bal. |
| 12 | 13.0 | 10.1 | 3.5 | 3.8 | 3.1 | 4.3 | 3.1 | 0.07 | 0.007 | — | — | — | — | 0.3 | Bal. |
| 13 | 13.5 | 10.5 | 1.5 | 4.3 | 4.9 | 3.8 | 2.5 | 0.08 | 0.015 | — | — | 0.2 | — | — | Bal. |
| 14 | 12.5 | 9.7 | 2.4 | 4.6 | 3.8 | 4.5 | 2.9 | 0.07 | 0.013 | — | — | — | 0.1 | — | Bal. |
| 15 | 13.3 | 8.8 | 2.7 | 4.1 | 3.5 | 4.1 | 3.0 | 0.09 | 0.012 | 34 | — | 0.2 | — | — | Bal. |
| 16 | 14.2 | 9.3 | 3.0 | 3.9 | 3.8 | 3.9 | 2.8 | 0.11 | 0.010 | 15 | 12 | — | — | 0.05 | Bal. |

TABLE 3

| Sample No. | Composition (wt %, Ca and Mg by ppm) | | | | | | | | | | | | | | |
|---|---|---|---|---|---|---|---|---|---|---|---|---|---|---|---|
| | Cr | Co | Mo | W | Ta | Al | Ti | C | B | Ca | Mg | Pt | Rh | Re | Ni |
| Ni-base heat resistant alloy of invention | | | | | | | | | | | | | | | |
| 17 | 13.8 | 9.5 | 1.8 | 4.2 | 4.5 | 4.2 | 2.7 | 0.08 | 0.005 | 18 | 72 | — | 0.1 | — | Bal. |
| 18 | 12.1 | 9.0 | 2.1 | 4.0 | 3.3 | 4.1 | 2.7 | 0.08 | 0.011 | — | — | 0.05 | 0.05 | 0.05 | Bal. |
| 19 | 14.0 | 8.5 | 1.1 | 3.5 | 5.3 | 3.6 | 2.2 | 0.10 | 0.039 | — | — | 0.1 | 0.2 | — | Bal. |
| 20 | 13.0 | 10.1 | 3.5 | 3.8 | 3.1 | 4.3 | 3.1 | 0.12 | 0.007 | — | — | — | 0.1 | 0.3 | Bal. |
| 21 | 13.5 | 10.5 | 1.5 | 4.3 | 4.9 | 3.8 | 2.5 | 0.07 | 0.015 | 25 | 37 | 0.2 | 0.1 | — | Bal. |
| 22 | 12.5 | 9.7 | 2.4 | 4.6 | 3.8 | 4.5 | 2.9 | 0.07 | 0.013 | 74 | 5 | 0.06 | — | 0.07 | Bal. |
| 23 | 13.3 | 8.8 | 2.7 | 4.1 | 3.5 | 4.1 | 3.0 | 0.09 | 0.012 | 34 | 54 | 0.2 | — | 0.1 | Bal. |
| 24 | 14.2 | 9.3 | 3.0 | 3.9 | 3.8 | 3.9 | 2.8 | 0.11 | 0.010 | 10 | 12 | 0.05 | 0.05 | 0.05 | Bal. |

TABLE 4

| Conventional | Composition (wt %, Ca and Mg by ppm) | | | | | | | | | | | | | | | | |
|---|---|---|---|---|---|---|---|---|---|---|---|---|---|---|---|---|---|
| Sample No. | Cr | Co | Mo | W | Ta | Al | Ti | C | B | Zr | Hf | Ca | Mg | Pt | Rh | Re | Ni |
| Conventional Ni-base heat resistant alloy | | | | | | | | | | | | | | | | | |
| 1 | 14.1 | 9.9 | 1.5 | 4.3 | 4.6 | 4.1 | 2.8 | 0.08 | 0.014 | 0.037 | — | — | — | — | — | — | Bal. |
| 2 | 13.8 | 10.2 | 1.6 | 4.4 | 4.8 | 4.1 | 2.6 | 0.09 | 0.011 | 0.022 | 0.5 | 12 | — | — | 0.1 | — | Bal. |
| 3 | 13.9 | 10.3 | 1.6 | 4.3 | 4.8 | 4.0 | 2.7 | 0.08 | 0.009 | 0.013 | 1.3 | — | 80 | — | — | — | Bal. |
| 4 | 14.2 | 9.6 | 1.4 | 4.1 | 4.6 | 3.9 | 2.7 | 0.10 | 0.013 | 0.023 | 0.7 | 28 | 29 | — | — | — | Bal. |

TABLE 5

| Sample No. of Ni-base heat-resistant alloy | Surface nature and internal structure of columnar casting for gas turbine rotor blade: Number of concave flaws of 0.2 mm or greater dia. found by fluorescent flaw detection | Max. size of concavity/convexity in casting surfaces (mm): Outer surface | Max. size of concavity/convexity in casting surfaces (mm): Inner surface | Number of micro-pores in casting |
|---|---|---|---|---|
| Invention | | | | |
| 1 | 3 | 0.2 | 0.4 | 11 |
| 2 | 6 | 0.2 | 0.4 | 14 |
| 3 | 2 | 0.1 | 0.4 | 18 |
| 4 | 0 | 0.1 | 0.5 | 7 |
| 5 | 0 | 0.2 | 0.3 | 4 |
| 6 | 2 | 0.2 | 0.2 | 14 |
| 7 | 1 | 0.1 | 0.2 | 12 |
| 8 | 4 | 0.2 | 0.3 | 15 |

TABLE 6

| Sample No. of Ni-base heat-resistant alloy | Surface nature and internal structure of columnar casting for gas turbine rotor blade: Number of concave flaws of 0.2 mm or greater dia. found by fluorescent flaw detection | Max. size of concavity/convexity in casting surfaces (mm): Outer surface | Max. size of concavity/convexity in casting surfaces (mm): Inner surface | Number of micro-pores in casting |
|---|---|---|---|---|
| Invention | | | | |
| 9 | 2 | 0.1 | 0.2 | 11 |
| 10 | 1 | 0.2 | 0.4 | 10 |
| 11 | 4 | 0.2 | 0.2 | 8 |
| 12 | 2 | 0.2 | 0.3 | 9 |
| 13 | 0 | 0.1 | 0.2 | 5 |
| 14 | 1 | 0.2 | 0.3 | 12 |
| 15 | 3 | 0.2 | 0.4 | 14 |
| 16 | 6 | 0.2 | 0.2 | 16 |

TABLE 7

| Sample No. of Ni-base heat-resistant alloy | Surface nature and internal structure of columnar casting for gas turbine rotor blade: Number of concave flaws of 0.2 mm or greater dia. found by fluorescent flaw detection | Max. size of concavity/convexity in casting surfaces (mm): Outer surface | Max. size of concavity/convexity in casting surfaces (mm): Inner surface | Number of micro-pores in casting |
|---|---|---|---|---|
| Invention | | | | |
| 17 | 6 | 0.2 | 0.3 | 12 |
| 18 | 1 | 0.1 | 0.2 | 14 |
| 19 | 3 | 0.2 | 0.4 | 12 |
| 20 | 2 | 0.2 | 0.4 | 11 |
| 21 | 0 | 0.2 | 0.3 | 8 |
| 22 | 3 | 0.2 | 0.4 | 15 |
| 23 | 4 | 0.2 | 0.3 | 18 |
| 24 | 1 | 0.2 | 0.4 | 12 |

TABLE 8

| Comparative Sample No. of Ni-base heat-resistant alloy | Surface nature and internal structure of columnar casting for gas turbine rotor blade: Number of concave flaws of 0.2 mm or greater dia. found by fluorescent flaw detection | Max. size of concavity/convexity in casting surfaces (mm): Outer surface | Max. size of concavity/convexity in casting surfaces (mm): Inner surface | Number of micro-pores in casting |
|---|---|---|---|---|
| Conventional Ni-base heat-resistant alloy | | | | |
| 1 | 19 | 0.3 | 0.6 | 27 |
| 2 | 23 | 0.3 | 0.6 | 30 |
| 3 | 27 | 0.4 | 0.7 | 31 |
| 4 | 24 | 0.3 | 0.6 | 42 |

TABLE 9

| | Columnar cast plates wt %, Ca and Mg by ppm | | | | | | | |
|---|---|---|---|---|---|---|---|---|
| Elements | A | B | C | D | E | F | G | H |
| Cr | 13.1 | 14.0 | 12.5 | 13.5 | 13.3 | 12.2 | 13.3 | 14.2 |
| Co | 9.0 | 8.5 | 10.1 | 10.5 | 10.1 | 9.7 | 8.8 | 9.3 |
| Mo | 2.1 | 1.0 | 3.5 | 1.5 | 1.5 | 2.4 | 2.7 | 3.0 |
| W | 4.0 | 3.5 | 4.3 | 3.7 | 4.5 | 4.5 | 4.1 | 3.9 |
| Ta | 3.3 | 5.4 | 4.9 | 3.0 | 4.6 | 3.8 | 3.5 | 3.8 |
| Al | 4.0 | 3.5 | 4.3 | 3.7 | 4.1 | 4.5 | 4.1 | 3.9 |
| Ti | 2.7 | 2.3 | 3.2 | 2.5 | 2.7 | 2.9 | 3.0 | 2.8 |
| C | 0.08 | 0.10 | 0.06 | 0.12 | 0.06 | 0.07 | 0.09 | 0.11 |
| B | 0.011 | 0.009 | 0.007 | 0.015 | 0.010 | 0.013 | 0.012 | 0.010 |
| Ca | — | — | — | — | — | — | 53 | 10 |
| Mg | — | — | — | — | — | 81 | — | 12 |
| Pt | — | — | — | — | — | — | — | — |
| Rh | — | — | — | — | — | — | — | — |
| Re | — | — | — | — | — | — | — | — |
| Ni | Bal. | Bal. | Bal. | Bal. | Bal. | Bal. | Bal. | Bal. |

TABLE 10

| | Columnar cast plates wt %, Ca and Mg by ppm | | | | | | | |
|---|---|---|---|---|---|---|---|---|
| Elements | I | J | K | L | M | N | O | P |
| Cr | 13.8 | 12.1 | 14.0 | 13.0 | 13.5 | 12.5 | 13.3 | 14.2 |
| Co | 9.5 | 9.0 | 8.5 | 10.1 | 10.5 | 9.7 | 8.8 | 9.3 |
| Mo | 1.8 | 2.1 | 1.1 | 3.5 | 1.5 | 2.4 | 2.7 | 3.0 |
| W | 4.2 | 4.0 | 3.5 | 4.3 | 3.8 | 4.6 | 4.1 | 3.9 |
| Ta | 4.5 | 3.3 | 5.3 | 4.9 | 3.1 | 3.8 | 3.5 | 3.8 |
| Al | 4.2 | 4.1 | 3.6 | 4.3 | 3.8 | 4.5 | 4.1 | 3.9 |
| Ti | 2.7 | 2.7 | 2.2 | 3.1 | 2.5 | 2.9 | 3.0 | 2.8 |
| C | 0.08 | 0.08 | 0.10 | 0.07 | 0.12 | 0.07 | 0.09 | 0.11 |
| B | 0.005 | 0.011 | 0.039 | 0.007 | 0.015 | 0.013 | 0.012 | 0.010 |
| Mg | 72 | — | — | — | 37 | 5 | 54 | 12 |
| Pt | — | 0.05 | 0.1 | — | 0.2 | 0.06 | 0.2 | 0.05 |
| Rh | — | 0.05 | 0.2 | 0.1 | 0.1 | — | — | 0.05 |
| Re | — | 0.05 | — | 0.3 | — | 0.07 | 0.1 | 0.05 |
| Ni | Bal. | Bal. | Bal. | Bal. | Bal. | Bal. | Bal. | Bal. |

TABLE 11

| Elements | Columnar cast plates wt %, Ca and Mg by ppm a | b | c | d |
|---|---|---|---|---|
| Cr | 14.1 | 13.8 | 13.9 | 14.2 |
| Co | 9.9 | 10.2 | 10.3 | 9.6 |
| Mo | 1.5 | 1.6 | 1.6 | 1.4 |
| W | 4.3 | 4.4 | 4.3 | 4.1 |
| Ta | 4.6 | 4.8 | 4.8 | 4.6 |
| Al | 4.1 | 4.1 | 4.0 | 3.9 |
| Ti | 2.8 | 2.6 | 2.7 | 2.7 |
| C | 0.08 | 0.09 | 0.08 | 0.10 |
| B | 0.014 | 0.011 | 0.009 | 0.013 |
| Zr | 0.037 | 0.022 | 0.013 | 0.023 |
| Hf | — | — | 1.5 | 0.7 |
| Ca | — | 12 | — | 28 |
| Mg | 31 | 5 | 80 | 29 |
| Pt | — | — | — | — |
| Rh | — | — | — | — |
| Re | — | — | — | — |
| Ni | Bal. | Bal. | Bal. | Bal. |

TABLE 12

| Sample No. | Columnar cast plate | HIP conditions Temp. (° C.) | Press. (atm.) | Time (hr) | Solid solution treatment conditions Temp. (° C.) | Hold time (hr) | 1st stage aging conditions Temp. (° C.) | Hold time (hr) | 2nd stage aging conditions Temp. (° C.) | Hold time (hr) | Local melting | Time till rupture (hr) |
|---|---|---|---|---|---|---|---|---|---|---|---|---|
| Method of invention | | | | | | | | | | | | |
| 1 | A | — | — | — | 1205 | 5 | 950 | 10 | 753 | 24 | No melting | 108 |
| 2 | B | — | — | — | 1220 | 2 | 1050 | 7 | 840 | 24 | No melting | 113 |
| 3 | C | — | — | — | 1230 | 3 | 1050 | 3 | 870 | 16 | No melting | 113 |
| 4 | D | — | — | — | 1230 | 3 | 1050 | 3 | 870 | 16 | No melting | 120 |
| 5 | E | — | — | | 1240 | 2 | 1050 | 4 | 870 | 20 | No melting | 122 |
| 6 | F | — | — | — | 1265 | 1 | 1080 | 2 | 753 | 24 | No melting | 131 |
| 7 | G | — | — | — | 1230 | 3 | 1080 | 4 | 753 | 24 | No melting | 129 |
| 8 | H | — | — | — | 1230 | 3 | 1080 | 4 | 840 | 24 | No melting | 122 |
| 9 | I | — | — | — | 1230 | 3 | 1050 | 4 | 840 | 20 | No melting | 103 |
| 10 | J | — | — | — | 1230 | 3 | 1050 | 4 | 840 | 20 | No melting | 118 |

TABLE 13

| Sample No. or Comparative Sample No. | Columnar cast plate | HIP conditions Temp. (° C.) | Press. (atm.) | Time (hr) | Solid solution treatment conditions Temp. (° C.) | Hold time (hr) | 1st stage aging conditions Temp. (° C.) | Hold time (hr) | 2nd stage aging conditions Temp. (° C.) | Hold time (hr) | Local melting | Time till rupture (hr) |
|---|---|---|---|---|---|---|---|---|---|---|---|---|
| Method of invention | | | | | | | | | | | | |
| 11 | K | — | — | — | 1230 | 3 | 1050 | 4 | 840 | 20 | No melting | 111 |
| 12 | L | — | — | — | 1220 | 2 | 1050 | 4 | 840 | 20 | No melting | 116 |
| 13 | M | — | — | — | 1230 | 3 | 1050 | 4 | 840 | 20 | No melting | 126 |
| 14 | N | — | — | — | 1230 | 3 | 1050 | 4 | 840 | 20 | No melting | 113 |
| 15 | O | — | — | — | 1230 | 3 | 1050 | 4 | 840 | 20 | No melting | 104 |
| 16 | P | — | — | — | 1230 | 3 | 1050 | 4 | 840 | 20 | No melting | 113 |
| Comparative method | | | | | | | | | | | | |
| 17 | a | — | — | — | 1230 | 3 | 1050 | 4 | 840 | 20 | Melting | 77 |
| 18 | b | — | — | — | 1220 | 2 | 1050 | 4 | 840 | 20 | Melting | 82 |
| 19 | c | — | — | — | 1220 | 2 | 1050 | 4 | 870 | 20 | Melting | 14 |
| 20 | d | — | — | — | 1220 | 2 | 1050 | 4 | 870 | 20 | Melting | 23 |

TABLE 14

| Sample No. | Columnar cast plate | HIP conditions Temp. (° C.) | HIP conditions Press. (atm.) | HIP conditions Time (hr) | Solid solution treatment conditions Temp. (° C.) | Solid solution treatment conditions Hold time (hr) | 1st stage aging conditions Temp. (° C.) | 1st stage aging conditions Hold time (hr) | 2nd stage aging conditions Temp. (° C.) | 2nd stage aging conditions Hold time (hr) | Local melting | Time till rupture (hr) |
|---|---|---|---|---|---|---|---|---|---|---|---|---|
| Method of invention | | | | | | | | | | | | |
| 21 | A | 1180 | 1500 | 2 | 1220 | 2 | 950 | 10 | 840 | 20 | No melting | 122 |
| 22 | B | 1260 | 900 | 5 | 1230 | 3 | 1050 | 4 | 840 | 20 | No melting | 128 |
| 23 | C | 1180 | 1400 | 3 | 1205 | 5 | 1080 | 2 | 870 | 16 | No melting | 102 |
| 24 | D | 1170 | 1550 | 3 | 1220 | 2 | 1080 | 4 | 870 | 16 | No melting | 111 |
| 25 | E | 1200 | 1500 | 2 | 1230 | 3 | 1050 | 4 | 870 | 20 | No melting | 153 |
| 26 | F | 1200 | 1500 | 2 | 1240 | 2 | 1080 | 4 | 870 | 20 | No melting | 115 |
| 27 | G | 1200 | 1500 | 2 | 1265 | 1 | 1050 | 4 | 840 | 20 | No melting | 147 |
| 28 | H | 1180 | 1400 | 3 | 1220 | 2 | 1050 | 4 | 840 | 20 | No melting | 120 |
| 29 | I | 1180 | 1400 | 3 | 1220 | 2 | 1050 | 4 | 840 | 20 | No melting | 112 |
| 30 | J | 1180 | 1400 | 3 | 1220 | 2 | 1050 | 4 | 840 | 20 | No melting | 129 |

TABLE 15

| Sample No. and Comparative Sample No. | Columnar cast plate | HIP conditions Temp. (° C.) | HIP conditions Press. (atm.) | HIP conditions Time (hr) | Solid solution treatment conditions Temp. (° C.) | Solid solution treatment conditions Hold time (hr) | 1st stage aging conditions Temp. (° C.) | 1st stage aging conditions Hold time (hr) | 2nd stage aging conditions Temp. (° C.) | 2nd stage aging conditions Hold time (hr) | Local melting | Time till rupture (hr) |
|---|---|---|---|---|---|---|---|---|---|---|---|---|
| Method of invention | | | | | | | | | | | | |
| 31 | K | 1180 | 1400 | 3 | 1220 | 2 | 950 | 10 | 840 | 20 | No melting | 122 |
| 32 | L | 1200 | 1500 | 2 | 1220 | 2 | 1050 | 7 | 753 | 24 | No melting | 111 |
| 33 | M | 1200 | 1500 | 2 | 1230 | 3 | 1080 | 2 | 753 | 24 | No melting | 126 |
| 34 | N | 1200 | 1500 | 2 | 1230 | 3 | 1080 | 4 | 840 | 20 | No melting | 127 |
| 35 | O | 1200 | 1500 | 2 | 1230 | 3 | 1050 | 4 | 870 | 20 | No melting | 122 |
| 36 | P | 1200 | 1500 | 2 | 1230 | 3 | 1050 | 4 | 870 | 20 | No melting | 123 |
| Comparative method | | | | | | | | | | | | |
| 37 | a | 1200 | 1500 | 2 | 1230 | 3 | 1080 | 4 | 870 | 20 | Melting | 83 |
| 38 | b | 1200 | 1500 | 2 | 1230 | 3 | 1050 | 4 | 870 | 20 | Melting | 91 |
| 39 | c | 1200 | 1500 | 2 | 1230 | 3 | 1050 | 4 | 840 | 20 | Melting | 18 |
| 40 | d | 1200 | 1500 | 2 | 1230 | 3 | 1050 | 4 | 840 | 20 | Melting | 36 |

TABLE 16

| Elements | Large-size columnar cast plates of the invention wt %, Ca and Mg by ppm 1 | 2 | 3 | 4 | 5 | 6 | 7 | 8 |
|---|---|---|---|---|---|---|---|---|
| Cr | 13.1 | 14.0 | 12.5 | 13.5 | 13.3 | 12.2 | 13.3 | 14.2 |
| Co | 9.0 | 8.5 | 10.1 | 10.5 | 10.1 | 9.7 | 8.8 | 9.3 |
| Mo | 2.1 | 1.0 | 3.5 | 1.5 | 1.5 | 2.4 | 2.7 | 3.0 |
| W | 4.0 | 3.5 | 4.3 | 3.7 | 4.5 | 4.5 | 4.1 | 3.9 |
| Ta | 3.3 | 5.4 | 4.9 | 3.0 | 4.6 | 4.8 | 3.5 | 3.8 |
| Al | 4.0 | 3.5 | 4.3 | 3.7 | 4.1 | 4.5 | 4.1 | 3.9 |
| Ti | 2.7 | 2.3 | 3.2 | 2.5 | 2.7 | 2.9 | 3.0 | 2.8 |
| C | 0.08 | 0.10 | 0.06 | 0.12 | 0.06 | 0.07 | 0.09 | 0.11 |
| B | 0.011 | 0.009 | 0.007 | 0.015 | 0.010 | 0.013 | 0.012 | 0.010 |
| Zr | 1.3 | 2.6 | 1.2 | 4.3 | 0.05 | 0.005 | 0.1 | 0.6 |
| Ca | — | — | — | — | — | — | 53 | 10 |
| Mg | — | — | — | — | — | 81 | — | 12 |
| Pt | — | — | — | — | — | — | — | — |
| Rh | — | — | — | — | — | — | — | — |
| Re | — | — | — | — | — | — | — | — |
| Ni | Bal. | Bal. | Bal. | Bal. | Bal. | Bal. | Bal. | Bal. |

TABLE 17

| Elements | Large-size columnar cast plates of the invention wt %, Zr, Ca and Mg by ppm | | | | | | | |
|---|---|---|---|---|---|---|---|---|
| | 9 | 10 | 11 | 12 | 13 | 14 | 15 | 16 |
| Cr | 13.8 | 12.1 | 14.0 | 13.0 | 13.5 | 12.5 | 13.3 | 14.2 |
| Co | 9.5 | 9.0 | 8.5 | 10.1 | 10.5 | 9.7 | 8.8 | 9.3 |
| Mo | 1.8 | 2.1 | 1.1 | 3.5 | 1.5 | 2.4 | 2.7 | 3.0 |
| W | 4.2 | 4.0 | 3.6 | 4.3 | 3.8 | 4.6 | 4.1 | 3.9 |
| Ta | 4.5 | 3.3 | 5.3 | 4.9 | 3.1 | 3.8 | 3.5 | 3.8 |
| Al | 4.2 | 4.1 | 3.6 | 4.3 | 3.8 | 4.5 | 4.1 | 3.9 |
| Ti | 2.7 | 2.7 | 2.2 | 3.1 | 2.5 | 2.9 | 3.0 | 2.8 |
| C | 0.08 | 0.08 | 0.10 | 0.07 | 0.12 | 0.07 | 0.09 | 0.11 |
| B | 0.005 | 0.011 | 0.039 | 0.007 | 0.015 | 0.013 | 0.012 | 0.010 |
| Zr | 19 | 0.3 | 0.8 | 1.9 | 2.3 | 3.6 | 0.03 | 0.7 |
| Ca | 18 | — | — | — | 25 | 74 | 34 | 10 |
| Mg | 72 | — | — | — | 37 | 5 | 34 | 10 |
| Pt | — | 0.05 | 0.1 | — | 0.2 | 0.06 | 0.2 | 0.05 |
| Rh | — | 0.05 | 0.2 | 0.1 | 0.1 | — | — | 0.05 |
| Re | — | 0.05 | — | 0.3 | — | 0.07 | 0.1 | 0.05 |
| Ni | Bal. | Bal. | Bal. | Bal. | Bal. | Bal. | Bal. | Bal. |

TABLE 18

| Elements | Large-size columnar cast plates of prior art wt % (Zr inclusive), Ca and Mg by ppm | | | |
|---|---|---|---|---|
| | 17 | 18 | 19 | 20 |
| Cr | 14.1 | 13.8 | 13.9 | 14.2 |
| Co | 9.9 | 10.2 | 10.3 | 9.6 |
| Mo | 1.5 | 1.6 | 1.6 | 1.4 |
| W | 4.3 | 4.4 | 4.3 | 4.1 |
| Ta | 4.6 | 4.8 | 4.8 | 4.6 |
| Al | 4.1 | 4.1 | 4.0 | 3.9 |
| Ti | 2.8 | 2.6 | 2.7 | 2.7 |
| C | 0.08 | 0.09 | 0.08 | 0.10 |
| B | 0.014 | 0.011 | 0.009 | 0.013 |
| Zr | 0.037 | 0.022 | 0.013 | 0.023 |
| Hf | — | — | 1.5 | 0.7 |
| Ca | — | 12 | — | 28 |
| Mg | 31 | 5 | 80 | 29 |
| Pt | — | — | — | — |
| Rh | — | — | — | — |
| Re | — | — | — | — |
| Ni | Bal. | Bal. | Bal. | Bal. |

TABLE 19

| Sample No. and Comparative Sample No. | Average depth of erosion (μm) |
|---|---|
| Large-size columnar cast plates of invention | |
| 1 | 34 |
| 2 | 88 |
| 3 | 84 |
| 4 | 167 |
| 5 | 48 |
| 6 | 105 |
| 7 | 62 |
| 8 | 57 |
| 9 | 70 |
| 10 | 188 |
| 11 | 47 |
| 12 | 151 |
| 13 | 124 |
| 14 | 175 |

TABLE 19-continued

| Sample No. and Comparative Sample No. | Average depth of erosion (μm) |
|---|---|
| 15 | 91 |
| 16 | 59 |
| Large-size columnar cast plates of known art | |
| 17 | 701 |
| 18 | 560 |
| 19 | 498 |
| 20 | 545 |

Obviously, numerous modifications and variations of the present invention are possible in light of the above teachings. It is therefore to be understood that within the scope of the appended claims, the invention may be practiced otherwise than as specifically described herein.

The priority documents of the present application, Japanese patent applications Nos. 09-010346, 09-010347, and 09-096526, filed on Jan. 23, 1997, Jan. 23, 1997 and Mar. 31, 1997, respectively, are hereby incorporated by reference.

What is claimed is:

1. A columnar crystalline Ni-base alloy for a casting comprising, by weight:

Cr: from 12.0 to 14.3%, Co: from 8.5 to 11.0%, Mo: from 1.0 to 3.5%, W: from 3.5 to 6.2%, Ta: from 3.0 to 5.5%, Al: from 3.5 to 4.5%, Ti: from 2.0 to 3.2%, C: from 0.04 to 0.12%, B: from 0.005 to 0.05%, and the balance Ni and inevitable impurities, and further comprising 0.001 to 5 ppm Zr.

2. The columnar crystalline Ni-base alloy of claim 1, further comprising, by weight:

0.5 to 100 ppm of at least one member selected from the group consisting of Mg and Ca.

3. The columnar crystalline Ni-base alloy of claim 1, further comprising, by weight:

at least one member selected from the group consisting of Pt: from 0.02 to 0.5%, Rh: from 0.02 to 0.5% and Re: from 0.02 to 0.5%.

4. The columnar crystalline Ni-base alloy of claim 2, further comprising, by weight:

at least one member selected from the group consisting of Pt: from 0.02 to 0.5%, Rh: from 0.02 to 0.5% and Re: from 0.02 to 0.5%.

5. A casting cast from columnar crystalline Ni-base alloy of claim 1.

6. A casting cast from columnar crystalline Ni-base alloy of claim 4.

7. A casting cast from columnar crystalline Ni-base alloy of claim 3.

8. A turbine blade cast from columnar crystalline Ni-base alloy of claim 1.

9. A turbine blade cast from columnar crystalline Ni-base alloy of claim 4.

10. A turbine blade cast from columnar crystalline Ni-base alloy of claim 3.

11. A method for producing a cast article, comprising:

casting an article from the Ni-based alloy of claim 1;

subjecting the article to a solid-solution treatment at 1200 to 1265° C.; and subjecting the article to a two-staged aging heat treatment comprising, a first stage of holding the article at 950 to 1080° C. for 2 to 10 hours, and a second stage of holding the article at 750 to 880° C. for 16 to 24 hours.

12. A method for producing a cast article, comprising:

casting an article from the Ni-based alloy of claim 4;

subjecting the article to a solid-solution treatment at 1200 to 1265° C.; and subjecting the article to a two-staged aging heat treatment comprising, a first stage of holding the article at 950 to 1080° C. for 2 to 10 hours, and a second stage of holding the article at 750 to 880° C. for 16 to 24 hours.

13. A method for producing a cast article, comprising:

casting an article from the Ni-based alloy of claim 3;

subjecting the article to a solid-solution treatment at 1200 to 1265° C.; and subjecting the article to a two-staged aging heat treatment comprising, a first stage of holding the article at 950 to 1080° C. for 2 to 10 hours, and a second stage of holding the article at 750 to 880° C. for 16 to 24 hours.

14. The method for producing a cast article of claim 11, further comprising:

subjecting the article to hot isostatic pressing prior to said solid-solution heat treatment.

15. The method for producing a cast article of claim 14, further comprising:

subjecting the article to hot isostatic pressing prior to said solid-solution heat treatment.

16. The method for producing a cast article of claim 13, further comprising:

subjecting the article to hot isostatic pressing prior to said solid-solution heat treatment.

17. A product produced by the method of claim 11.

18. A product produced by the method of claim 12.

19. A product produced by the method of claim 13.

20. A turbine blade produced by the method of claim 14.

21. A turbine blade produced by the method of claim 15.

22. A turbine blade produced by the method of claim 16.

23. A method for producing a cast article, comprising:

casting an article from Ni-based alloy;

subjecting the article to a solid-solution treatment at 1200 to 1265° C.; and subjecting the article to a two-staged aging heat treatment comprising, a first stage of holding the article at 950 to 1080° C. for 2 to 10 hours, and a second stage of holding the article at 750 to 880° C. for 16 to 24 hours, wherein said Ni-based alloy consisting essentially of, by weight:

Cr: from 12.0 to 14.3%, Co: from 8.5 to 11.0%, Mo: from 1.0 to 3.5%, W: from 3.5 to 6.2%, Ta: from 3.0 to 5.5%, Al: from 3.5 to 4.5%, Ti: from 2.0 to 3.2%, C: from 0.04 to 0.12%, B: from 0.005 to 0.05%, and the balance Ni and inevitable impurities.

24. The method for producing a cast article of claim 23, further comprising:

subjecting the article to hot isostatic pressing prior to said solid-solution heat treatment.

25. A turbine blade produced by the method of claim 24.

* * * * *

UNITED STATES PATENT AND TRADEMARK OFFICE

CERTIFICATE OF CORRECTION

PATENT NO. : 6,036,791

DATED : March 14, 2000

INVENTOR(S): Akira MITSUHASHI et al.

It is certified that an error appears in the above-identified patent and that said Letters Patent is hereby corrected as shown below:

On the title page, item [54], and Column 1, is incorrectly listed. The title should read as follows:

--- [54] COLUMNAR CRYSTALLINE NI-BASE HEAT-RESISTANT ALLOY HAVING HIGH RESISTANCE TO INTERGRANULAR CORROSION AT HIGH TEMPERATURE, METHOD OF PRODUCING THE ALLOY, LARGE-SIZE ARTICLE, AND METHOD OF PRODUCING LARGE-SIZE ARTICLE FROM THE ALLOY ---

Also, Item [75], the 4th, 5th and 6th Inventors' have been omitted. Item [ 75 ] should read as follows:

--- [75] Inventors: Akira Mitsuhashi; Michi Misumi; Saburou Wakita, all of Omiya-shi, Hisataka KAWAI; Kouji Takahashi; Ikuo Okada, all of Takasago-shi; all of Japan Signed and Sealed this Tenth Day of April, 2001

*Attest:*

Nicholas P. Godici

NICHOLAS P. GODICI

*Attesting Officer*

*Acting Director of the United States Patent and Trademark Office*